US007987893B2

(12) United States Patent
Clark et al.

(10) Patent No.: US 7,987,893 B2
(45) Date of Patent: Aug. 2, 2011

(54) METHODS OF FORMING METAL MATRIX COMPOSITES AND METAL MATRIX COMPOSITES FORMED THEREBY

(75) Inventors: Daniel Clark, Derby (GB); Jeffrey Allen, Derby (GB)

(73) Assignee: Rolls-Royce PLC, London (GB)

( * ) Notice: Subject to any disclaimer, the term of this patent is extended or adjusted under 35 U.S.C. 154(b) by 801 days.

(21) Appl. No.: 11/702,607

(22) Filed: Feb. 6, 2007

(65) Prior Publication Data

US 2008/0011444 A1 Jan. 17, 2008

(30) Foreign Application Priority Data

Mar. 23, 2006 (GB) ..... 0605927.3

(51) Int. Cl.
*B22D 19/14* (2006.01)

(52) U.S. Cl. ..... 164/97

(58) Field of Classification Search ..... 164/98, 164/97; 228/225, 226, 245–247, 248.1, 249, 228/41

See application file for complete search history.

(56) References Cited

U.S. PATENT DOCUMENTS

| | | | | |
|---|---|---|---|---|
| 3,493,713 | A | 2/1970 | Johnson | |
| 3,776,297 | A | 12/1973 | Williford et al. | |
| 3,889,348 | A | 6/1975 | Lemelson | |
| 4,090,827 | A * | 5/1978 | Attwell | 425/64 |
| 4,508,158 | A | 4/1985 | Amateau et al. | |
| 4,625,095 | A | 11/1986 | Das | |
| 4,691,093 | A * | 9/1987 | Banas et al. | 219/121.63 |
| 4,752,537 | A * | 6/1988 | Das | 428/614 |
| 4,782,205 | A * | 11/1988 | Shira | 219/74 |
| 4,995,444 | A * | 2/1991 | Jolly et al. | 164/97 |
| 5,248,079 | A | 9/1993 | Li | |
| 6,064,031 | A | 5/2000 | Talwar | |
| 2003/0068518 | A1 * | 4/2003 | Ando et al. | 428/608 |
| 2004/0020904 | A1 * | 2/2004 | Andrees et al. | 219/121.63 |

FOREIGN PATENT DOCUMENTS

| | | |
|---|---|---|
| DE | 122 044 | 8/1975 |
| JP | A 7-090421 | 4/1995 |
| JP | 10140264 A | 11/1996 |
| JP | A 2003-154444 | 5/2003 |

* cited by examiner

*Primary Examiner* — Kevin P Kerns

(74) *Attorney, Agent, or Firm* — Oliff & Berridge, PLC

(57) ABSTRACT

The invention provides a method of forming a metal matrix composite (MMC) comprising a metal matrix and a fibrous material embedded therein, the method comprising bringing the metal matrix into the molten state and contacting the fibrous material with the metal matrix in the molten state in a directionally controlled manner, whereby the Young's modulus of the resultant cooled MMC is controlled in one or more particular direction and optionally at one or more particular location.

17 Claims, 6 Drawing Sheets

METHODS OF FORMING METAL MATRIX COMPOSITES AND METAL MATRIX COMPOSITES FORMED THEREBY

FIELD OF THE INVENTION

The present invention relates to methods of forming metal matrix composites and metal matrix composites formed thereby.

The invention also relates to the use of such metal matrix composites as articles and welds, for example in aircraft components and other applications where a combination of load-bearing strength, stiffness and lightness is required.

BACKGROUND OF THE INVENTION

Metal matrix composites (MMCs) are composed of reinforcing fibres embedded in a metal or metal alloy (herein collectively: "metal") matrix. The fibres are of a material which has a higher melting point than the metal matrix.

The superior physical properties of such materials in comparison with metals make MMCs an attractive alternative to metals in applications where a combination of load-bearing strength, stiffness and lightness is required, for example in aircraft components having weight-reducing internal voids.

U.S. Pat. No. 4,625,095, the disclosure of which is incorporated herein by reference, describes a method of welding MMC articles by creating a fibre-reinforced weld comprising generally about 12 to 20 vol % of fibres. The weld metal is initially supplied via a consumable source of metal, and the fibres are supplied into the molten zone of the weld metal. In effect, the resultant weld material is itself an MMC. The method is intended to yield a weld material having properties close to those of the MMC articles being welded. The fibres are stated to preferably have a diameter in the range of from 0.1 to 0.4 microns (μm) and an aspect ratio (length/diameter) in the range of from 20:1 to 200:1.

A disadvantage with the method as described in U.S. Pat. No. 4,625,095 is that the very small particles align randomly and uncontrollably in the molten metal matrix, with the result that the physical properties of the resultant cooled solid material may suffer. A particular disadvantage that has been found is poor stiffness (Young's modulus) in one or more particular direction or at one or more particular location.

U.S. Pat. No. 4,625,095 acknowledges (passage bridging columns 2 and 3) that continuous or specifically orientated filaments may be used, to produce anisotropic properties in the composite.

However, a disadvantage with the known methods for producing anisotropic properties in MMCs is that the net shape of the MMC body typically changes during the forming process, with the result that extensive machining can be subsequently required, which is costly and inefficient.

The present invention aims to provide improved or at least alternative MMCs usable both as articles and welds.

BRIEF DESCRIPTION OF THE INVENTION

According to a first aspect of the present invention, there is provided a method of forming an MMC comprising a metal matrix and a fibrous material embedded therein, the method comprising bringing a region of the metal matrix into the molten state by heating and feeding the fibrous material into the metal matrix in the molten state in a directionally controlled manner, whereby the Young's modulus of the resultant cooled MMC is controlled in one or more particular direction and optionally at one or more particular location.

A laser, hot gas or electron beam is preferably arranged to heat the metal matrix so as to create a molten zone having a relatively hot leading region and a relatively cool trailing region, the forward direction being the direction of travel of the molten zone. The temperature differential between the two regions may, for example, be as much as 1000° C.

According to a second aspect of the present invention, there is provided a method of forming an MMC comprising a metal matrix and a fibrous material embedded therein, the method comprising bringing the metal matrix into the molten state by heating to create a molten zone having a relatively hot leading region and a relatively cool trailing region, the forward direction being the direction of travel of the molten zone, and contacting the fibrous material with the metal matrix in the molten state in a directionally controlled manner, whereby the Young's modulus of the resultant cooled MMC is controlled in one or more particular direction and optionally at one or more particular location.

The method of the second aspect of the present invention may suitably be performed by heating the molten zone in a horseshoe, V or U shaped heating line, the apex of the heating line being directed in the leading (forwards) direction, whereby a relatively hot region of the molten zone is surrounded by the heat. Alternatively, multiple (eg opposed pair) spot heating may be carried out, whereby a relatively hot region of the molten zone is surrounded by the heat spots.

In one embodiment the fibrous material may comprise one or more continuous fibres and the method comprises laying the fibre(s) into a pool of molten metal matrix in a directionally controlled manner. Where the heating does not heat across the central part of the leading region of the molten zone (eg where multi-spot heating is used) the one or more continuous fibre may be fed to the molten zone from either ahead of (front feeding) or from behind (rear feeding) the molten zone. On the other hand, where the heating does heat across the central part of the leading region of the molten zone (eg where the heating line is horseshoe, V or U shaped) the one or more continuous fibre should be fed to the molten zone only from behind the molten zone (rear feeding), to prevent heat damage to the fibre(s).

In another embodiment, the directional control of the process of contacting the fibrous material with the molten metal matrix may conveniently be achieved by using elongate fibrous particles having a longitudinal dimension (y dimension) substantially longer than in the prior art, for example at least about 0.7 mm in length and preferably up to about 3.5 mm in length, and preferably having an aspect ratio of between about 2:1 and about 50:1, and the particles are directionally guided into contact with the molten metal matrix.

In the case of one or more continuous fibre, the expression "directionally controlled manner" refers to the control of the direction in which the fibre(s) contact the molten metal and are subsequently embedded in the metal matrix. In the case of elongate fibrous particles, the expression "directionally controlled manner" refer to the control of the orientation of the particles or at least a majority of them relative to the metal matrix, both at the point of contact with the molten metal and as embedded in the resultant MMC. In both cases, the objective of the directional control of the fibrous material is to achieve directional control of the Young's modulus of the resultant MMC. For example, for a simple elongate whole fibre, the Young's modulus will be higher in the direction in which the fibre is orientated.

It is preferred that particulate fibrous material is contacted with a relatively cool region of the molten zone, and not a relatively hot region.

According to a third aspect of the present invention, there is provided a method of forming an MMC comprising a metal matrix and a fibrous material embedded therein, the fibrous material comprising elongate fibrous particles having a longitudinal dimension (y dimension) at least about 0.7 mm in length and preferably up to about 3.5 mm in length, and preferably having an aspect ratio of between about 2:1 and about 50:1, the method comprising bringing the metal matrix into the molten state and guiding the particles into contact with the molten metal matrix such that a majority of the particles are in a controlled orientation with respect to the molten metal matrix on contact with the molten metal matrix, whereby the Young's modulus of the resultant cooled MMC is controlled in one or more particular direction and optionally at one or more particular location.

In the method according to the third aspect of the present invention, the metal matrix may conveniently be brought into the molten state using a laser, hot gas or electron beam. A laser, hot gas or electron beam is preferable because arcing is thereby avoided and a generally even and controllable (eg temperature-controllable) heating effect is achieved transversely across the region of the melt pool into which the fibrous material is to be introduced. The metal matrix to be brought into the molten state may be the surface of a metal workpiece or may be supplied by a consumable powder feed of the metal introduced into the laser or electron beam in conventional manner (for example, using the procedure known as direct laser deposition), or by a consumable piece (eg length or foil) of the metal, one part of which is located in the laser or electron beam path in conventional manner.

It is preferred that the dwell time of the molten zone is kept as short as possible, to minimise degradation of the fibrous material, to minimise the adverse effects of convention currents and density differentials in the solidifying MMC. In the method of the invention, the molten zone or pool is caused to advance leaving behind it the cooled resultant MMC.

If desired, the methods of the present invention may be repeated over the same workpiece, to incrementally build up a three-dimensional MMC structure.

According to a fourth aspect of the present invention, there is provided an MMC formed by the method of the first, second or third aspect of the invention.

The MMCs according to the present invention may find use both as articles and welds. The articles may be any article where a combination of load-bearing strength, stiffness and lightness is required. For example, the article may have internal weight-reducing voids, for example voids separated by webs in the manner of trusses or honeycombs. Alternatively the voids could be produced by producing bubbles in a fibre material during manufacture. The shape of the pores can be configured as required, for example by rolling the reinforced fibre material to produce elongate voids. In one particular embodiment, the present invention provides aircraft components, for example an aircraft landing strut, comprising an MMC according to the invention. In other particular embodiments, the articles may be pipes, for example. The expression "articles" used herein includes parts of articles, for example flanges.

It is found that the use of a laser or electron beam to bring the metal matrix into the molten state for receiving the fibrous material can be more dimensionally controllable than other methods for melting the matrix, so avoiding the need for subsequent machining to adjust the dimensions. It is also found that the use of relatively large particles of the fibrous material enables improved directional control of the particles entering into contact with the molten matrix.

DETAILED DESCRIPTION OF THE INVENTION

The Metal Matrix

The metal matrix may suitably comprise lightweight metals such as aluminum, titanium or magnesium and their alloys. Of these, aluminium and magnesium and their alloys have a relatively low melting point, which makes them very suitable for use in forming MMCs, as the requirement that the fibres should be compatible with the metal matrix (in particular: have a higher melting point than the metal matrix so that the fibres can be introduced into the metal matrix when the metal matrix is in the molten state) is then easily observed. Iron and its alloys may also be used. However, these have higher melting points. Super-alloys, such as alloys based on cobalt, nickel, columbium or tantalum, may also be used as matrix metals.

It is preferred that, to minimise the formation of voids in the MMC, the metal should have a higher coefficient of thermal expansion/contraction than the fibrous material and the material of any reinforcing filaments.

Where the metal matrix is aluminium, it may be necessary to avoid the use of a laser to melt the matrix, in view of the high reflectivity of aluminium.

The Fibrous Material

The expressions "fibre" and "fibrous" used herein are to be understood broadly as referring to any generally elongate shape, ie having a relatively long (y) and a relatively short (x) dimension.

The fibrous material may comprise any fibrous material conventionally used in MMCs, for example boron, graphite, alumina, silicon carbide, silicon nitride fibres or any combination thereof. Indeed the fibrous material may comprise any ceramic or intermetallic material. The fibrous material may alternatively, or additionally, comprise metallic fibres, the metal being selected to have a higher melting point than that of the metal matrix. The use of a metal fibrous material may be particularly advantageous in the situation where the fibrous material is one or more continuous fibre (eg a steel fibre may be useful in a precipitation hardened aluminium alloy matrix; a tungsten fibre may be useful in a steel matrix).

The fibrous material will be selected having regard to the metal used in the matrix, to ensure good compatibility (in particular: the melting point of the fibrous material is above that of the metal matrix). The fibres should be selected to have a good interfacial bond with the matrix metal so that the composite has enhanced properties over those of the unreinforced matrix metal. The fibres should also be capable of withstanding the potentially reactive conditions created upon contact with the molten matrix metal.

To avoid the formation of fibre agglomerates, a volatile organic binder may be coated on the fibers before introduction into the molten matrix metal. Alternatively or additionally, a thin coating (for example, between about 10 and about 50 μm in thickness) of the matrix metal may be applied to the fibres before their introduction into the molten matrix metal, to reduce fibre-to-fibre contact.

Where one or more continuous filament is to be used to provide directional reinforcement of the MMC, the filament may be of the same material as the fibre particles described above, and the expressions "fibre" and "fibrous" used herein include both fibre particles and one or more continuous fibres.

Fibre Shapes and Dimensions

The elongate fibres may have any suitable shape and dimensions, provided that the shape has a longitudinal (y) direction.

For example, the fibre particles may have a generally rod shape, a generally tube shape, a generally lozenge shape, a generally paraboloid shape, a generally dumbbell shape, a generally elongated hoop shape, or a generally spiral shape.

The particles of a population may be all of one shape or may be any mixture of the above shapes optionally with one or more other shapes.

The fibres may if desired have projecting and/or indented surface features such as ripples or flanges. These will serve to increase the area of interface between the matrix and the fibres, which will assist bonding and load transfer, and may reduce shear at the interface. A low amplitude rippling wave along the particles may be particularly suitable, for achieving these advantages—and thereby improving the load-bearing strength (proof strength) of the MMC without creating excessive stress concentrations. Projecting and/or indented surface features may conveniently be applied by conventional surface coating and/or etching techniques. The fibres should generally have rounded or smooth contours and edges so as to minimise stress locations at the interfaces between the fibres and the metal matrix.

Tapered fibrous particles are generally preferred over cylindrical particles. In particular, when small loads are applied to the resultant MMC, stress is believed to be transferred elastically from the matrix to the fibres. In the case of a tapered fibre, the axial stress is distributed over more of the length of the fibre per unit volume of fibre than in the case of an untapered fibre, thereby making greater use of the length of the fibre in reinforcement. The volume of a paraboloidal fibre is about half that of a uniform cylinder of the same length, so that half as much reinforcement material is required to make a paraboloidal fibre as a cylindrical one. Especially where weight is an important factor for the articles in which the MMC is to be used, the reduction in the amount of reinforcement material used is highly desirable, as the fibrous material is often denser than the matrix material. A further advantage of tapered fibres is that they are less likely to fracture than cylindrical fibres of the same length. When the force applied to a composite is low, stress will tend to be transferred to its fibres elastically, and increasing the force will lead to plastic stress transfer and—eventually—to failure. During plastic stress transfer, the stress in a fibre is greatest at the centre, and so this is the most likely site for failure. Failure is more likely in a cylindrical fibre than in a paraboloidal one of the same length, because the tensile stress at its centre is 1.5 times as great for the cylinder as for the paraboloid.

A suitable shape for a fibrous particle for use in the present invention is therefore an elongate fibre having parabolically tapered ends.

The fibrous particles may have hollow centres, which can provide a good weight reduction without unacceptably compromising the reinforcing effects.

The fibrous particles may suitably be manufactured by casting or any other known forming process.

The aspect ratio (y/x) of the particles is generally in the range of about 2:1 to about 50:1, for example about 2:1 to about 40:1, for example about 2:1 to about 30:1, for example about 2:1 to about 20:1, for example about 4:1 to about 15:1.

The x dimension of the particles is suitably in the range of about 150 to about 350 μm, for example about 200 to about 300 μm. In particular, for example, rod-shaped particles may suitably have an x dimension from about 200 to about 300 μm, tube-shaped particles may suitably have an x dimension from about 200 to about 300 μm, lozenge-shaped particles may suitably have an x dimension (maximum) of about 300 μm, and paraboloid-shaped particles may suitably have an x dimension (maximum) of about 300 μm.

The x dimension of the continuous fibres is suitably somewhat larger than that of the particles, for example between about 0.3 and about 0.6 mm, eg about 0.5 mm.

The y dimension of the particles is suitably in the range of about 0.7 to about 3.5 mm, for example about 1 to about 3 mm, for example about 1 to about 2 mm. In particular, for example, rod-shaped particles may suitably have a y dimension from about 1 to about 3 mm, tube-shaped particles may suitably have a y dimension from about 1 to about 3 mm, lozenge-shaped particles may suitably have a y dimension from about 1 to about 2 mm, and paraboloid-shaped particles may suitably have a y dimension from about 1 to about 2 mm.

Of course, the y dimension of the continuous fibres is very much longer than the y dimension of the particles. The precise y dimension of the continuous fibre is not important to the present invention, and the continuous fibre will simply be cut when the MMC formation is completed.

Heating the Matrix Metal

Any suitable conventional laser, hot gas or electron beam heating apparatus may be used in the present invention.

A suitable hot gas apparatus may, for example, provide a controlled temperature convection heated jet of an inert gas such as argon or helium.

Where the method of the present invention is performed by heating the molten zone in a horseshoe, V or U shaped heating line, or as multiple heating spots, appropriate masks or shields are provided to direct the heating line or spots as desired.

Contacting the Fibrous Material with the Molten Metal

The method of the present invention if preferably performed under an inert shroud gas such as argon. The apparatus suitably comprises a conventional laser or electron beam apparatus provided with one or both of: a system for laying one or more continuous fibre into the molten zone and a system for introducing a feed stream of particulate fibrous material.

The system for introducing particulate fibrous material into the molten zone should preferably be arranged to maximise the uniformity of orientation of the particles as they enter the molten zone. This is achieved in part by using relatively large particles, which have a relatively greater momentum in the feed stream. The use of a gas-entrained feed stream is preferred, but would require a fluidisation stage, whereby the fibrous particles would be vibrated as a mass at sufficient frequency to behave as a fluid. Preferably, this would be done in a small hopper-fed chamber (eg about 300 cubic cm in volume) close to the molten zone. The fluidised fibres would then be blown down a tube using inert gas at the melt pool.

An alternative method of introducing the fibrous particles into the molten zone would be to entrain the fibres in suspension in a volatile organic liquid, which would be flashed off (volatilised) by a suitable heat source such as a glow lamp or infra-red diode prior to entering the molten zone.

When the fibrous material is one or more continuous fibre, it will suitably be contacted with the molten metal matrix in conventional manner, for example laying the continuous fibre into the advancing molten zone by means of a conventional guide roller. The continuous fibre may if desired be heated to assist wetting of the molten matrix material around the continuous fibre.

When the fibrous material comprises two or more parallel fibres, each of which may be coated with a material which is similar or identical to the composition of matrix material. The matrix material forms a bond between the fibres and also a barrier to prevent the fibres from contacting one another in use. Typically the coating should be 50 micron thick. The coating may also include a thin layer of a eutectic coating (for example boron for a nickel alloy matrix) to locally depress the melting point of the matrix material and hence increase the amount of time the matrix stays molten around the fibre to allow for optimum positioning.

The one or more continuous fibre should enter the molten zone or pool when that zone or pool is in the liquid or semi-solid state. Positioning of the fibre(s) to +/−0.1 mm or better (tighter) is normally desirable. The fibre(s) may typically be about 0.5 mm in diameter. The molten zone or pool should therefore have an effective deposition width of at least approximately 1.4 mm, allowing for twin, locally-heated spots about 0.3 mm wide and a distance of about 0.15 mm to the nominal fibre centre.

It can be advantageous if the molten zone or pool has a somewhat horseshoe shape, the legs of the horseshoe extending in the reverse direction relative to the direction of travel of the molten zone in the MMC formation method. This horseshoe shape is caused by the local heating effect of the laser or electron beam which creates twin hot spots on opposite sides of the molten zone. It is believed that providing a horseshoe shaped molten zone or pool will cause a potentially substantial limiting effect on damaging epitaxial grain growth during the solidification of the molten zone. Furthermore, the fibrous material—especially a continuous metallic fibrous material—may provide advantageous nucleation sites for grains forming from the molten zone or pool, so limiting epitaxial growth and central segragation.

When the fibrous material is in the form of fibrous particles, the particles may suitably be contacted with the molten metal matrix by introducing the particles into the molten zone in the presence of a directional ordering agent for the particles. Such a directional ordering agent may conveniently be introduced into the molten zone separately from the fibrous particles, for example on a suitable fusible substrate. The substrate may preferably be adapted so that the ordering agent can be released from its surface into the molten metal after contact is made with the molten metal matrix. For example, the fusible substrate may be a consumable source (eg wire) of metal for forming the molten metal zone or pool, the substrate carrying on its surface a ceramic-surfactant nanocomposite film containing a highly ordered array of nanocylinders. The surfactant would be initially baked off at a location very close (eg a few tens of mm) to the molten zone and then the substrate would be fused in the molten zone or pool to release the ordering agent for the fibrous particles. If used in combination with one or more continuous fibres as the fibrous material, this would permit a hierarchical composite system to be formed (ie two size distributions of reinforcement), so allowing a greater degree of flexibility in tuning the reinforcement provided by the invention.

Alternatively, when the fibrous material is in the form of fibrous particles, the particles may suitably be contacted with the molten metal matrix by introducing the particles into the molten zone from a fluidised or other suitable feed hopper, through a delivery tube which is lined with a low friction material and which is sufficiently narrow that a majority of the particles have a preference to pass down the tube with their longitudinal axes aligned with the stream direction. The particles will then enter the molten zone in a generally uniformly aligned manner.

It is preferred that the fibrous particles are introduced into the molten zone in a region of the molten zone which is not the hottest, ie in a region behind the leading edge of the advancing molten zone, where cooling has already begun. For example, the fibrous particles may suitably be introduced into a region of the molten zone where the temperature is up to about 1000° C. lower than the temperature of the hottest region of the molten zone.

The introduction of the fibrous particles into the molten zone may be continuous or intermittent, and the extent of continuity can be adjusted to control localised Young's moduli within the resultant MMC.

Further details of the manufacturing techniques are given below in the detailed description of the drawings, and any such discussion will be understood to be generally applicable across the full range of embodiments of the present invention.

BRIEF DESCRIPTION OF THE DRAWINGS

For further illustration of the present invention, and to show how it may be performed, an embodiment will now be described, purely by way of example and without limitation, with reference to the accompanying drawings.

In the drawings.

DETAILED DESCRIPTION OF THE DRAWINGS

Referring firstly to FIGS. 1 to 4, a method of forming an MMC is shown schematically.

Figure 1:
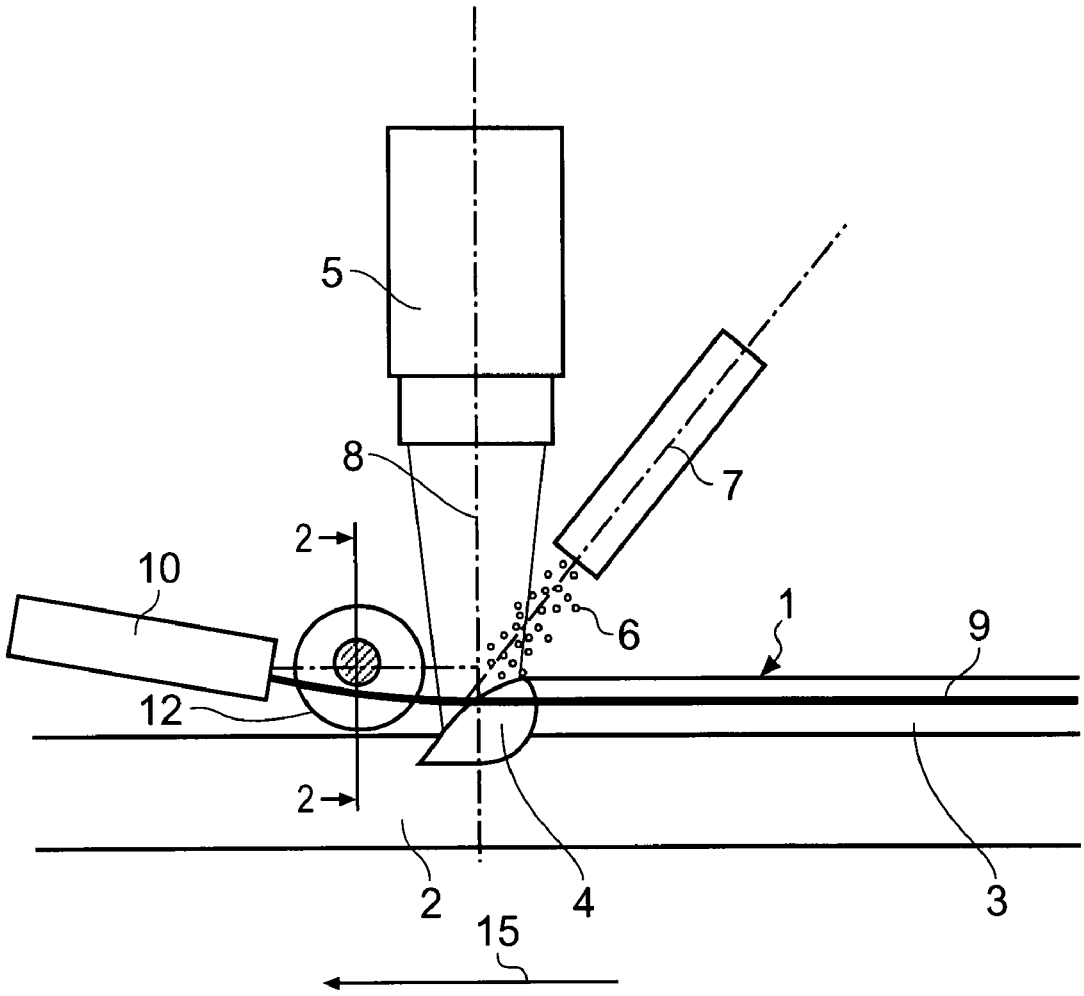
FIG. 1 is a schematic diagram from the side, showing a method of forming an MMC.
Figure 3:
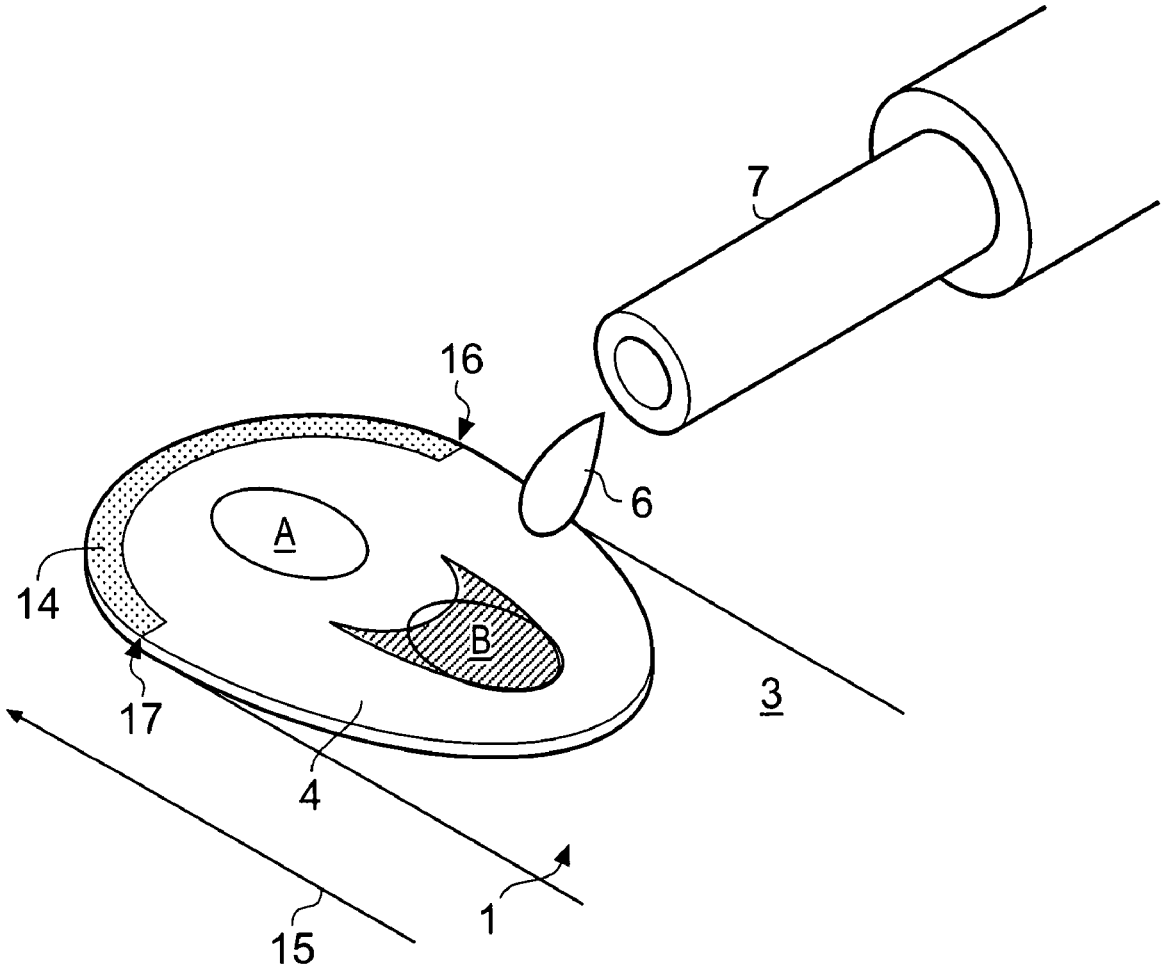
FIG. 3 is a perspective view of the molten zone in a method of forming an MMC.

A line of the MMC 1 is being deposited on a substrate 2 in the right-to-left direction as illustrated in FIGS. 1 and 3. A solidified already-formed zone 3 of the MMC lies generally to the right-hand side of FIG. 1, and a molten zone 4 of the MMC is being formed in generally the centre of FIG. 1. The molten zone 4 is created by a laser source 5 and fibrous particles 6 are fed into the molten zone as required from a particle feed system including a fluidising/vibrating hopper (not shown) via a particle feed tube 7 propelled by a inert gas such as argon. The flow rate of the particles 6 is controlled by a shutter control system (not shown), which may, for example, be controlled via a photoelectric diode or the like.

The laser beam path is illustrated at 8.

Figure 2:
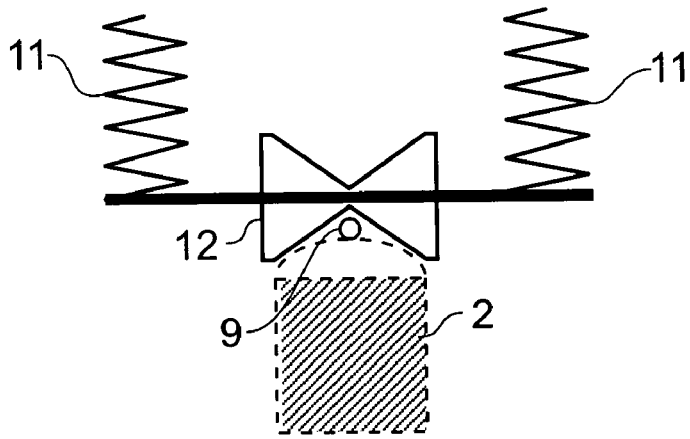
FIG. 2 is a cross-sectional view of the diagram of FIG. 1 along the line 2-2 and looking in the direction of the arrows.
Figure 5:
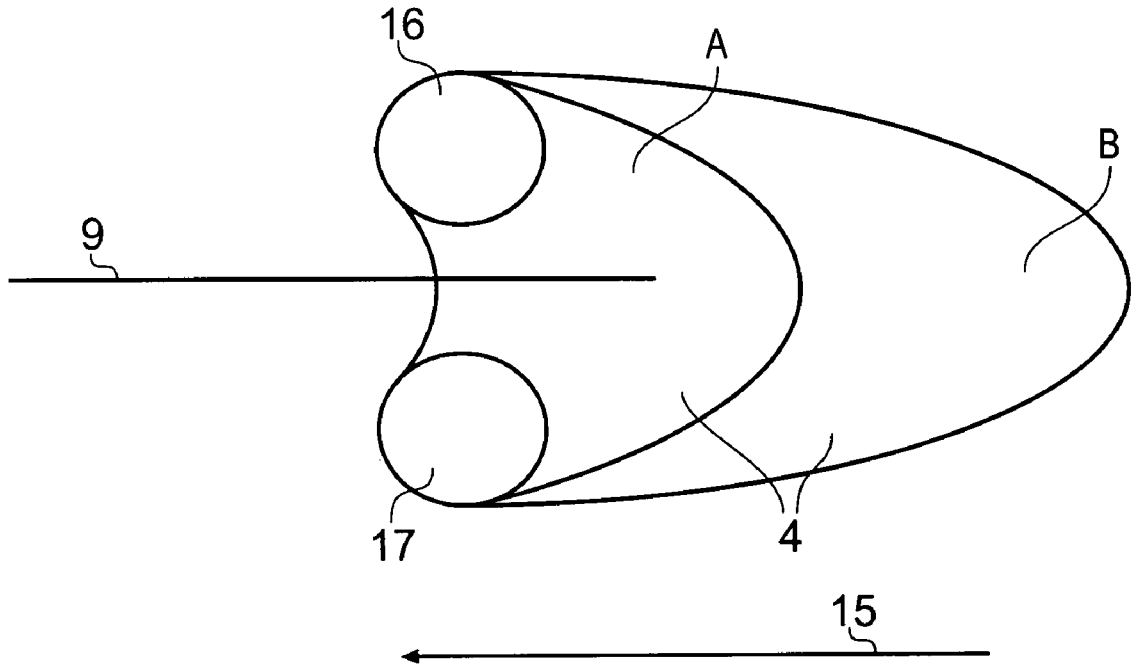
FIG. 5 is a detailed top view of a further alternative molten zone in a method of forming an MMC.

In the arrangement shown in FIGS. 1, 2 and 5, the MMC is further reinforced by a front-fed single continuous reinforcing fibre 9, the continuous fibre 9 being delivered as required from a delivery system 10 under guidance from a conventional spring 11-mounted positioning roller 12. The fibre 9 is thus orientated such that its long dimension is in line with the direction of the deposited line of MMC 1.

The laser/electron beam source 5, particle feed tube 7 and reinforcing wire positioning roller 12 move together in the leftwards direction as illustrated in FIGS. 1 and 5, causing the molten zone 4 to move correspondingly to the left. In this way, the MMC line 1 is deposited on the substrate 2.

A consumable rod 13 of matrix metal is used to feed matrix metal into the molten zone in conventional manner. For simplicity, the consumable rod 13 is only illustrated in FIG. 4.

Figure 4:
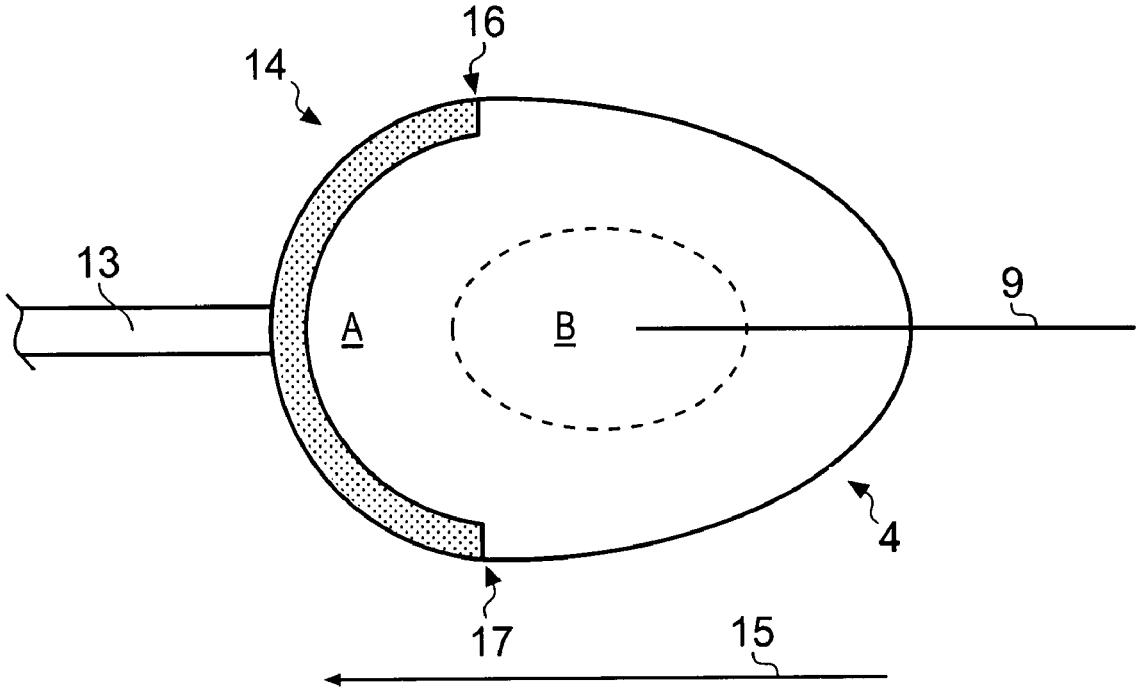
FIG. 4 is a detailed top view of an alternative molten zone in a method of forming an MMC.

As shown most clearly in FIGS. 3 and 4, the laser 5 provides a horseshoe shaped heating effect 14 on the matrix metal, the legs of the horseshoe extending in the reverse direction relative to the direction of travel of the molten zone shown by arrow 15. This horseshoe shape is caused by the local heating effect of the laser which creates twin hot spots 16, 17 on opposite sides of the molten zone 4.

As shown most clearly in FIG. 3, the fibrous particles 6 are preferably introduced into the molten zone 4 in a region B of the molten zone which is not the hottest, ie in a region behind the leading region A of the advancing molten zone, where cooling has already begun. For example, the region B of the molten zone 4 may be up to about 1000° C. cooler than region A of the molten zone 4.

Alternatively, as shown in FIG. 5, a different shaped heating effect is produced when multiple heating spots are used. The laser 5 provides a "heart" shaped heating effect 14 on the matrix metal, the apex of the "heart" pointing in the reverse direction relative to the direction of travel of the molten zone shown by arrow 15. This shape is caused by the local heating effect of the twin hot spots 16, 17 on opposite sides of the molten zone 4.

As in the above examples the fibrous particles 6 are preferably introduced into the molten zone 4 in a region B of the molten zone which is not the hottest, ie in a region behind the leading region A of the advancing molten zone, where cooling has already begun. The reinforcing fibre 9 is fed into the molten zone from ahead of the molten zone (front feeding) between the hot spots 16,17.

Figure 6:
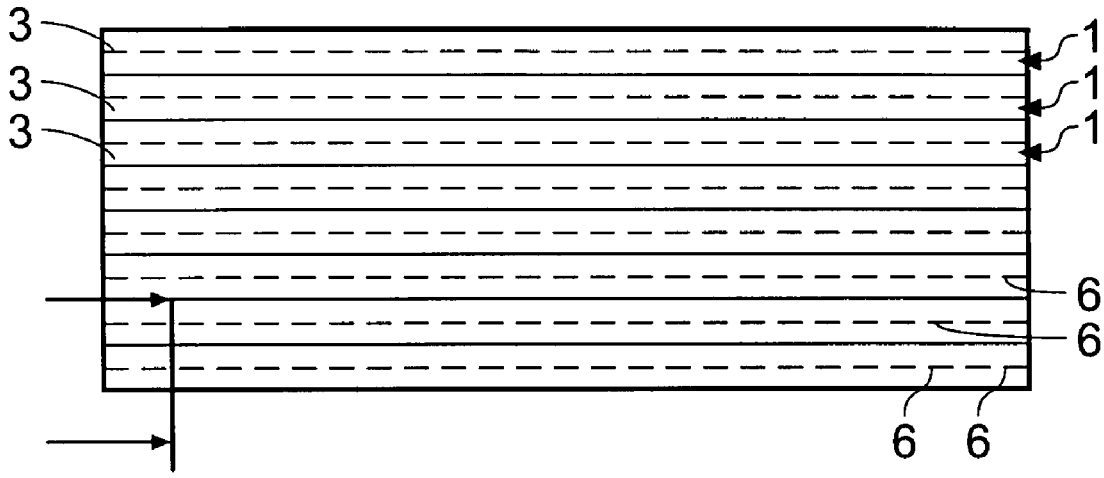
FIG. 6 shows a plan view of multiple MMC lines.
Figure 7:
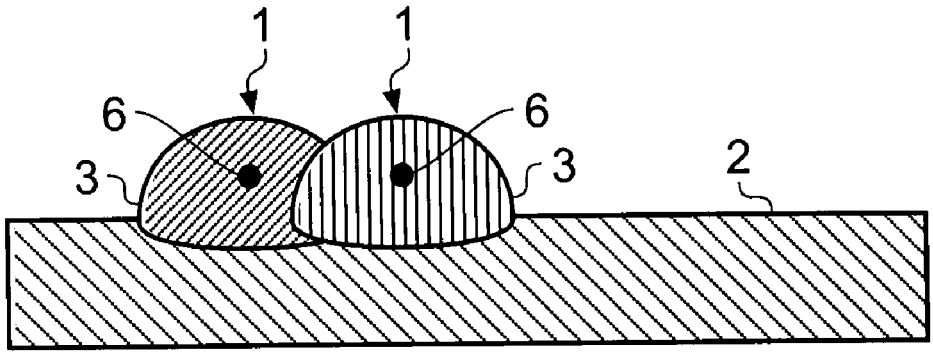
FIG. 7 shows a cross-sectional view of the multiple lines taken at X-X in FIG. 6.
Figure 8A:
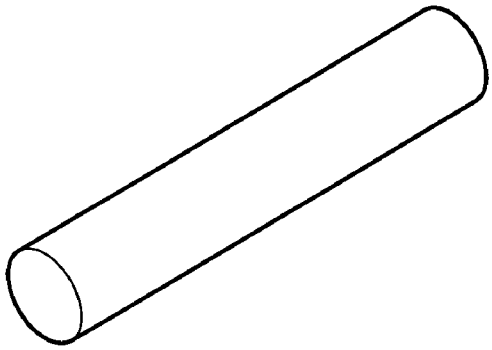
FIG. 8 illustrates four different shapes of fibrous particles for use in a method of forming an MMC.
Figure 8B:
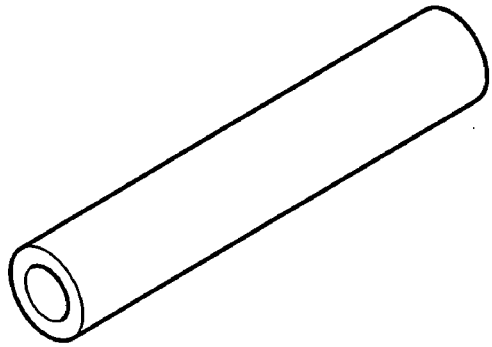
Figure 8C:
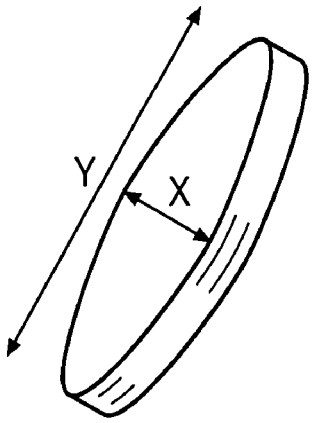
Figure 8D:
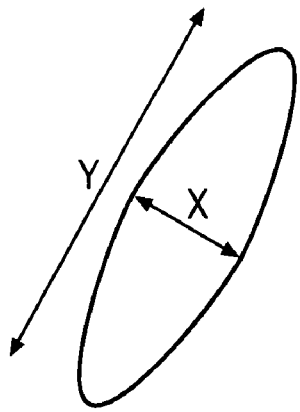

In embodiments where a plurality of reinforcement MMC lines 1 are formed, a plan view of which is shown in FIG. 6, where each line comprises fibrous particles, it may be advantageous to overlap the weld beads of adjacent MMC lines 1. A region where this is illustrated is cross section X-X in FIG. 6, as presented in FIG. 7. The weld beads may overlap by approximately 30%.

Within such a structure it is advantageous for the axial positions of the fibrous particles to be staggered, as shown in FIG. 6 above, so that there are no cross-section regions in which reinforcement is not provided.

The resultant individual MMC lines may, by way of non limiting example, have a height of approximately 500 microns, a width of approximately 1 mm, depth of fusion of approximately 100 to 300 microns and comprise a fibre having a diameter of not more than 300 microns.

In the embodiment shown in FIG. 3, the fibrous particles 6 are introduced into the molten zone from a fluidised or other suitable feed hopper, through a delivery tube 7 which is lined with a low friction material and which is sufficiently narrow that the particles have a preference to pass down the tube with their longitudinal axes aligned with the stream direction. The particles will then enter the molten zone in a generally uniformly aligned manner, as illustrated in FIG. 3. That is to say, in this embodiment the fibres are orientated such that their long dimension is in line with the direction of the deposited track of built structure.

Referring now to FIG. 8, a number of different possible shapes of multi-fibre particles are illustrated. In each particle, fibres (not shown) are immobilised in a known alignment pattern relative to one another.

The particles may have generally (a) rod, (b) tube, (c) lozenge or (d) paraboloid shapes. Populations of particles may comprise one or more of the said shapes and optionally one or more other shape as well.

The particles are elongate and have a long (y) dimension larger than their transverse (x) dimension. The aspect ratio (y/x) of the particles is generally in the range of about 2:1 to about 50:1, for example about 2:1 to about 40:1, for example about 2:1 to about 30:1, for example about 2:1 to about 20:1, for example about 4:1 to about 15:1.

The x dimension of the particles is suitably in the range of about 150 to about 350 μm, for example about 200 to about 300 μm. In particular, the rod-shaped particles (a) may suitably have an x dimension from about 200 to about 300 μm, the tube-shaped particles (b) may suitably have an x dimension from about 200 to about 300 μm, the lozenge-shaped particles (c) may suitably have an x dimension (maximum) of about 300 μm, and the paraboloid-shaped particles (d) may suitably have an x dimension (maximum) of about 300 μm. The tube-shaped particles (b) may suitably have an internal diameter in the range of about 50 to about 150 μm, for example about 75 to about 100 μm.

The lozenge-shaped particles (c) may have thickness (z dimension) in the range of about 100 to about 300 μm, for example about 200 μm.

The y dimension of the particles is suitably in the range of about 0.7 to about 3.5 mm, for example about 1 to about 3 mm, for example about 1 to about 2 mm. In particular, the rod-shaped particles (a) may suitably have a y dimension from about 1 to about 3 mm, the tube-shaped particles (b) may suitably have a y dimension from about 1 to about 3 mm, the lozenge-shaped particles (c) may suitably have a y dimension from about 1 to about 2 mm, and the paraboloid-shaped particles (d) may suitably have a y dimension from about 1 to about 2 mm.

INDUSTRIAL APPLICABILITY

The present invention goes at least some way towards solving the problem of poor directional control of Young's modulus in MMCs, and enables load-bearing articles such as aircraft components to be constructed from MMCs with directional and positional control of the Young's modulus.

For example, by varying the frequency and occurrence of the fibre-containing zones of the MMC, local Young's modulus can be tuned to different values at different locations in the MMC. If the MMC is used in an article which is subject to resonances, it will thus be possible to avoid particular damaging resonances.

Similarly, the pattern of load distribution within an MMC structure—for example a structure incorporating weight-reducing internal voids—can be set by local tuning of the Young's modulus across the internal structure or regions thereof, thereby spreading the loads and reducing the stresses imposed by peak loads over wider volumes and/or areas. In this way, the properties of structures which are subjected to dynamic (variable) loading events can be tailored to maintain an adequate safety margin.

The fibrous material may be arranged in a linear or non linear pattern around a component. For example, a strut may have fibrous material aligned axially along it or wound helically around it.

The above broadly describes the present invention without limitation. Variations and modifications as will be readily apparent to those skilled in the art are intended to be included within the scope of this application and subsequent patent(s).

The invention claimed is:

1. A method of forming a metal matrix composite comprising a metal matrix and a fibrous material embedded therein, the method comprising:

bringing a region of the metal matrix into a molten state to form a molten metal matrix by heating and feeding fibrous particles into the metal matrix in the molten state to align at least a substantial majority of the fibrous particles in substantially the same direction, wherein a Young's modulus of a resultant cooled metal matrix composite is controlled in at least one particular direction and optionally in at least one particular location.

2. The method of claim 1, wherein the molten metal matrix is formed using one of an electron beam, a laser and a hot gas.

3. The method of claim 2, wherein the electron beam laser or hot gas is arranged to heat the metal matrix so as to create a molten zone having a relatively hot leading region and a relatively cool trailing region, a forward direction being a direction of travel of the molten zone.

4. The method of claim 3, wherein a temperature differential between the leading region and trailing region is up to about 1000° C.

5. The method of claim 3 further comprising heating the molten zone in one of a horseshoe, V-shaped and U-shaped heating line, an apex of the heating line being directed in a forward direction, wherein a relatively hot region of the molten zone is provided by the heating line.

6. The method of claim 5, further comprising multiple-spot heating the molten zone, wherein a relatively hot region of the molten zone is provided by heat spots formed by the multiple-spot heating.

7. The method of claim 1, further comprising laying at least one continuous fiber into the molten metal matrix.

8. The method of claim 1, wherein the fibrous particles comprise elongate fibrous particles, the elongate fibrous particles directionally guided into contact with the molten metal matrix such that a majority of the elongate fibrous particles are in a controlled orientation with respect to the molten metal matrix on contact with the molten metal matrix.

9. The method of claim 8 wherein the fibrous particles comprising the elongate fibrous particles have a longitudinal dimension of at least about 0.7 mm in length.

10. The method of claim 8, wherein the fibrous particles comprising the elongate fibrous particles are contacted by a relatively cool region of the molten zone, and not a relatively hot region of the molten zone.

11. The method of claim 8, wherein the elongate fibrous particles are guided into contact with the molten metal matrix by passing the elongate fibrous particles in a stream through a channel which is sufficiently narrow such that the elongate fibrous particles are oriented preferentially with their longitudinal axes along a line of travel in the stream directed towards the molten metal matrix.

12. The method of claim 1, further comprising vibrating the fibrous particles at a sufficient frequency to behave as a fluid.

13. The method of claim 12, wherein the fibrous particles are vibrated in a hopper-fed chamber.

14. The method of claim 1, wherein a coefficient of thermal expansion/contraction of the metal matrix is higher than a coefficient of thermal expansion/contraction of the fibrous material.

15. The method of claim 1, wherein a melting point of the metal matrix is lower than a melting point of the fibrous material.

16. The method of claim 1, further comprising coating the fibrous material with a volatile organic binder.

17. The method of claim 1, further comprising coating the fibrous material with a thin coating of the at least one metal of the metal matrix.

* * * * *